United States Patent [19]

Baggio

[11] Patent Number: 4,724,626

[45] Date of Patent: Feb. 16, 1988

[54] SKI BOOT WITH A CLOSING DEVICE AND WITH A FOOT SECURING DEVICE

[75] Inventor: Giorgio Baggio, San Martino Di Lupari, Italy

[73] Assignee: Nordica S.p.A., Montebelluna, Italy

[21] Appl. No.: 925,007

[22] Filed: Oct. 28, 1986

[30] Foreign Application Priority Data

Nov. 4, 1985 [IT] Italy ..... 22704 A/85

[51] Int. Cl.[4] ..... A43B 5/04

[52] U.S. Cl. ..... 36/117; 36/50; 36/119; 24/68 SK

[58] Field of Search ..... 36/117–121, 36/50; 24/68 SK, 69 SK, 70 SK, 71 SK, 71.2; 340/696

[56] References Cited

U.S. PATENT DOCUMENTS

| | | | |
|---|---|---|---|
| 4,523,395 | 6/1985 | Borsoi | 36/119 |
| 4,583,305 | 4/1986 | Miyamoto | 36/119 |
| 4,615,127 | 10/1986 | Delery | 36/117 |
| 4,619,057 | 10/1986 | Sartor et al. | 36/50 |
| 4,620,378 | 11/1986 | Sartor | 36/119 |
| 4,620,379 | 11/1986 | Sartor | 36/119 |
| 4,624,064 | 11/1986 | Pozzebon | 36/119 |
| 4,626,847 | 12/1986 | Zato | 340/696 X |
| 4,631,839 | 12/1986 | Bonetti et al. | 36/50 |

FOREIGN PATENT DOCUMENTS

| | | | |
|---|---|---|---|
| 0214586 | 3/1987 | European Pat. Off. | 36/117 |

*Primary Examiner*—James Kee Chi

*Attorney, Agent, or Firm*—Guido Modiano; Albert Joseif

[57] ABSTRACT

The ski boot comprises a shell to which is associated at least one quarter. An electric motor is contained in the boot and has at least a controlling portion accessible from the outside. The electric motor is electrically connected to an electric power source accommodated inside the boot and is mechanically connected with a speed reducer. The output shaft of the speed reducer is operatively associated with straps for closing the boot and/or with cables or mechanism for securing the foot inside the boot. In the controlling portion accessible from the outside, push-buttons are provided for selective actuation of the electric motor with the possibility of rotation in one direction and with the possibility of rotation in the opposite direction to vary accordingly the rotation of said output shaft.

15 Claims, 15 Drawing Figures

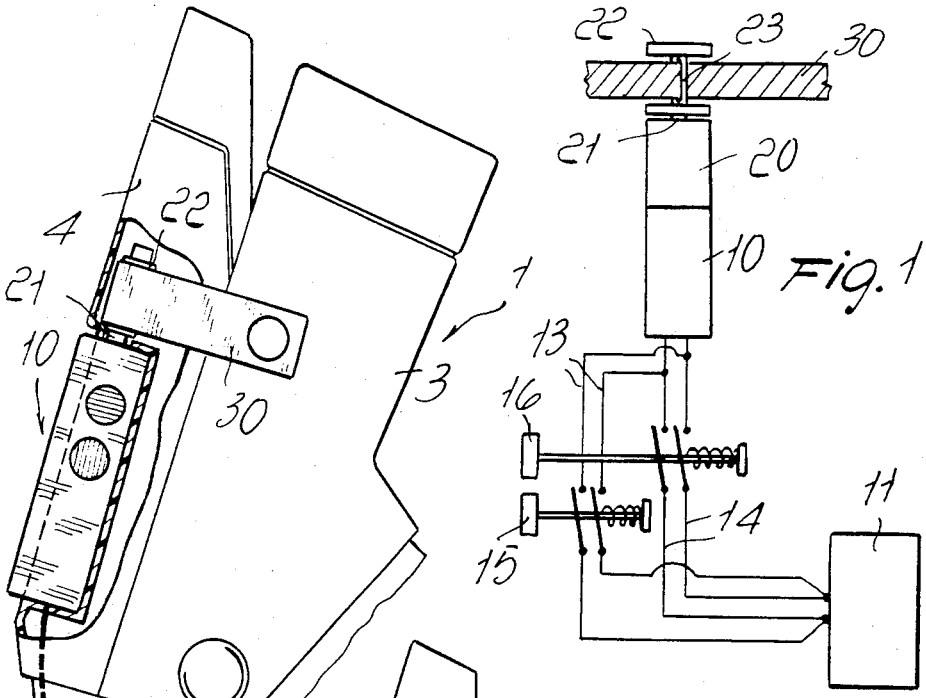
Fig. 1
Fig. 2
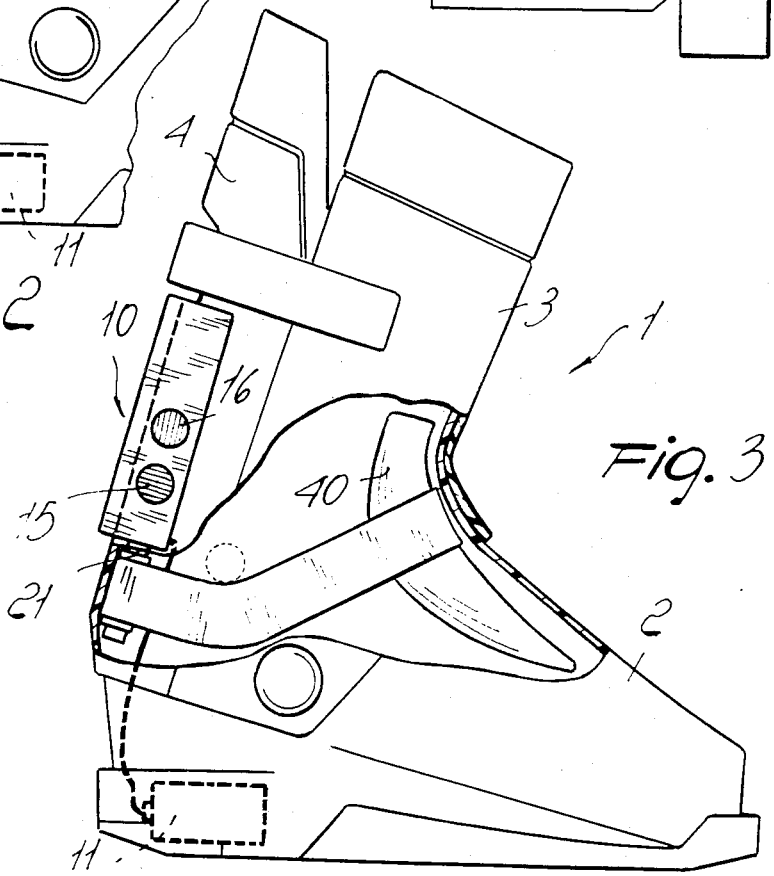
Fig. 3

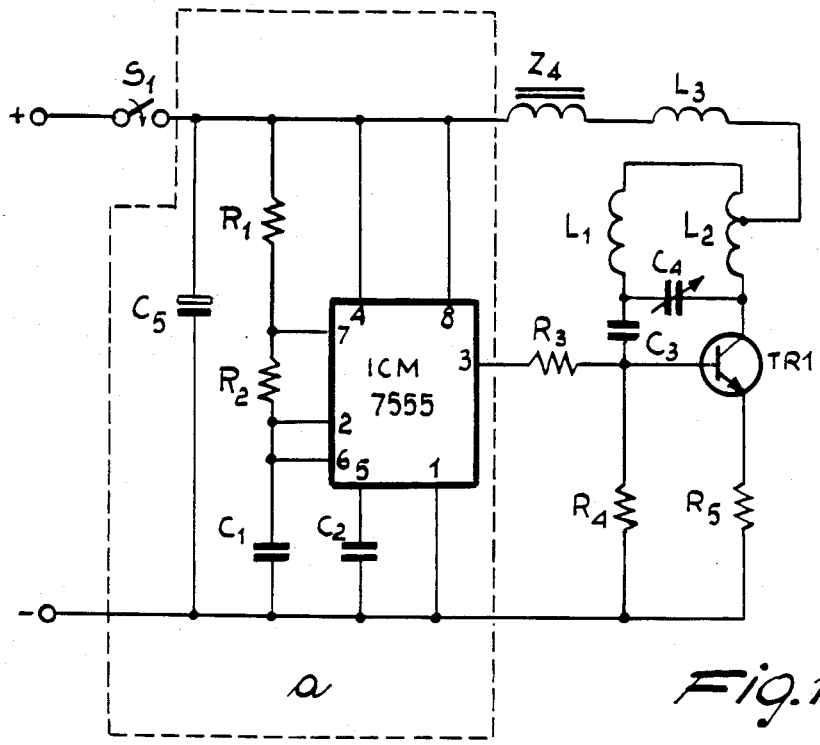
Fig. 11
Fig. 13
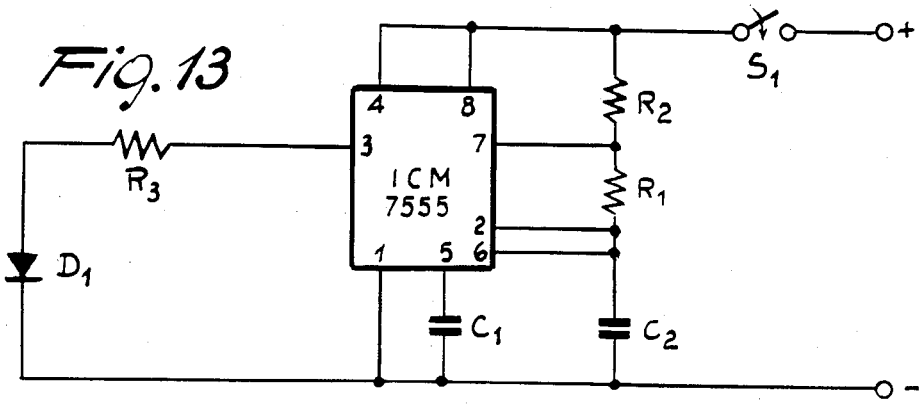
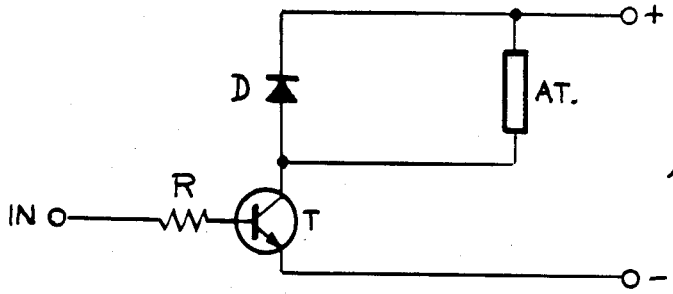
Fig. 15

SKI BOOT WITH A CLOSING DEVICE AND WITH A FOOT SECURING DEVICE

BACKGROUND OF THE INVENTION

The present invention relates to a ski boot with movable operating component parts, such as closing devices and/or foot securing devices.

As is known, the closing devices applied on ski boots are generally composed of hooks which employ the principle of the lever and which, in many situations, are difficult to operate.

Other known closing systems entail the use of a spool, e.g. of the type illustrated in the U.S. Pat. No. 4,433,456 by the same Applicant, which performs the winding of a cable so as to perform the tightening, e.g., of the quarters on each other in order to perform the closing, or possibly the tightening of the foot instep presser, of the heel presser, and so on.

Other known solutions which mostly perform the securing of the foot exploit the principle of the coupling between a screw and a female thread which allows to convert a rotating motion, imparted from outside, into a shift of the pivot and consequently of the heel presser, of the foot instep presser, and so on, associated thereto.

In all the known solutions, the operation of said devices, which are strictly mechanical, is performed by exerting a certain manual effort, possibly reduced by means of mechanical contrivances; this effort is however directly proportional to the tightening force it is desired to exert, so that in many conditions this operation is tiresome and scarcely acceptable for the user.

This operation is all the more bothersome if it is taken into account that it must be generally performed while keeping the trunk bent forwards and, generally, on tracks which are on a slope.

SUMMARY OF THE INVENTION

The aim proposed by the invention is indeed to solve the above described problems by completely eliminating the need for performing uncomfortable manual operations, and also avoiding any effort in the closing action.

Within the scope of the above described aim, a particular object of the invention is to provide a ski boot wherein it is possible to motorize all the actuations possibly required, making these actuations much easier and acceptable for the user.

Still another object of the present invention is to provide a ski boot which, though having remarkably improved characteristics, is conceptually similar to conventional type boots, with the only difference that the conventional actuations are carried out with different criteria.

Not least object of the present invention is to provide a ski boot which is simple to provide and which, furthermore, by virtue of its peculiar operating characteristics, allows to achieve a wide diffusion among the users.

As will be clear for the expert in the field, the idea of motorizing all the actuations and motions of certain component and/or accessory parts of a ski boot, while appearing simple as an abstractive idea, in reality entails remarkable problems, which are not easy to solve, if one takes into account the limited available room, the limited weight that the motorizing assembly must have and the limited reserves of energy which normally can be autonomously available in the boot. The problem of energy saving, and the problem of the easy control of the motorized actuations, have proved to be particularly important.

The above described problems, as well as the objects mentioned and others which will better appear hereinafter, are solved, according to the invention, by a ski boot with a structure composed of a shell to which is associated at least one quarter and in which are provided operative component parts, among which at least one closing device and/or at least one foot securing device, as well as an electric power source, characterized by an operating assembly for said operative component parts, comprising an electric motor accommodated in a protective recess provided in the structure of the boot, said motor being of the reversible kind, reversible control means for the electric motor accommodated inside the structure of the boot and sensitive to the external control actuation, circuit means for the electric connection between the electric motor, the electric power source and said reversible control means, transmission means for converting the rotation created by the electric motor into operation of said operative component parts, said circuit means and said transmission means comprising elements which cooperate with each other.

BRIEF DESCRIPTION OF THE DRAWINGS

Further characteristics and advantages will become better apparent from the description of preferred, but not exclusive, embodiments of a ski boot with a closing device and with a foot securing device, operated electrically, illustrated only by way of non-limitative example in the accompanying drawings, where:

FIG. 1 is the functional diagram of the closing and/or securing devices provided inside the boot:

FIG. 2 is a view of a ski boot with a quarter closing device:

FIG. 3 is a view of a ski boot with a foot instep presser actuation device:

FIG. 11 is a circuit diagram of a radio-wave transmitter for the remote control of the securing device according to the invention;

FIG. 13 is a circuit diagram of an infrared-ray transmitter for the remote control of the securing device according to the invention;

FIG. 15 is a view of a typical connection between the final transistor of the receiving device and the actuators of the securing device.

DESCRIPTION OF THE PREFERRED EMBODIMENTS

Figure 4:
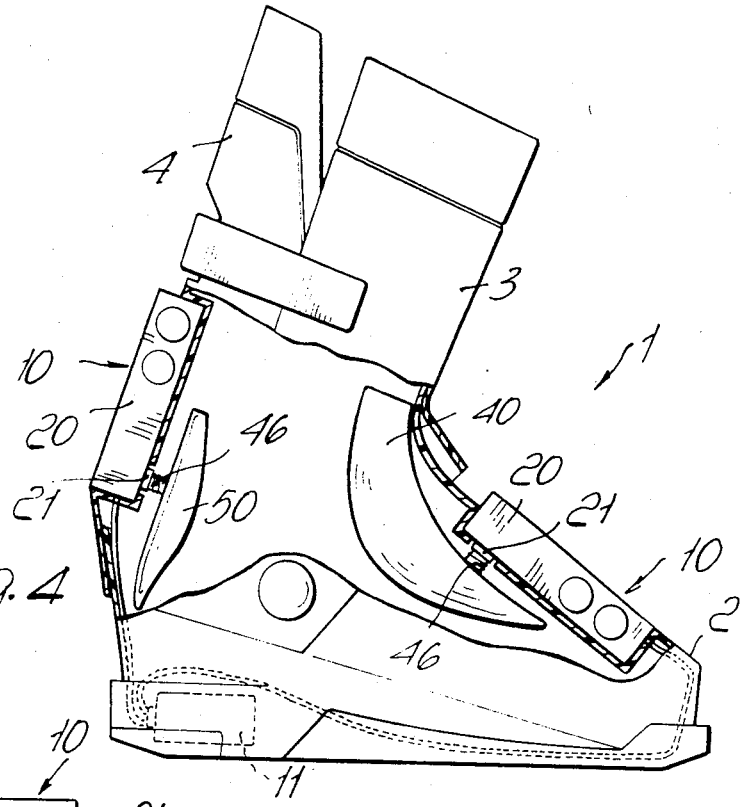
FIG. 4 is a partially cutout lateral elevation view of a ski boot with a foot instep presser device, and a heel presser device.

With reference to FIGS. 1–6, the ski boot with a closing device and with a foot securing device, operated electrically, according to the invention, which is generally designated with the reference numeral 1, comprises in its general constituting lines a conventional shell 2 to which are coupled, in a per se known manner, a front quarter 3 and a rear quarter 4; obviously it is also possible to provide a ski boot of the so-called front-entry type, wherein only one quarter is provided.

In its general lines, the boot 1 is provided with an electric motor, designated with the reference numeral 10, which is connected, as will be better described hereinafter, at the surface of one of the parts composing the boot and defines a component part of the boot which is accessible from the outside.

The electric motor 10 is electrically connected with an electric power source consisting of a rechargeable accumulator or of a battery 11 which is accommodated in a recess provided inside the boot, preferably, but not necessarily, at the rear part of the sole.

The connection between the electric motor 10 and the accumulator 11 is provided by virtue of an assembly which allows the reversal of the polarity to achieve the rotation of the motor 10 in one direction or in an opposite direction.

In a preferred embodiment, which is schematically illustrated in FIG. 1, a first pair of electrical conductors 13 is provided which interconnects the motor 10 and the battery 11 with certain polarities and a second pair of conductors 14 which interconnects the motor 10 and the battery 11 with reversed polarity.

On the first and on the second pair of conductors 13 and 14 act respectively a first push-button 15 and a second push-button 16 which, once pressed, allow to interconnect electrically the motor 10 with the battery 11.

In this manner, by acting on one push-button or the other, there is the possibility of making the motor 10 rotate in one direction or in the opposite direction.

An interlocking element is furthermore provided between the push-buttons 15 and 16 in order to prevent the simultaneous closing actuation thereof, which would cause a short circuit at the battery.

Figure 9:
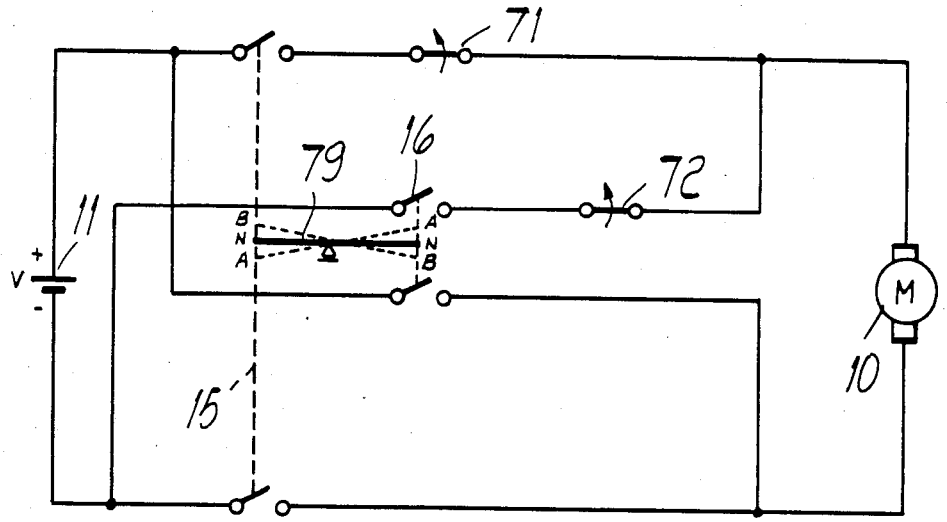
FIG. 9 is an electrical diagram of an operating circuit of the closing and/or securing device.

The interlocking element can, e.g., be composed of a rod 79 connected, at its two ends, with the push-buttons 15 and 16 and pivoted in a middle point thereof as schematically illustrated in FIG. 9. This mechanical connection between the push-buttons 15 and 16, by virtue of the rod 79, restricts their relative motions, allowing only three positions: a first neutral position (N) wherein both push-buttons are disconnected, a second position (A) wherein only the push-button 15 is connected while the push-button 16 is disconnected, a third position (B) wherein the push-button 15 is disconnected while the push-button 16 is connected. It is obvious that the mechanism of which the rod 79 is a part prevents the simultaneous closing of the switches controlled by the push-buttons 15 and 16. In another possible embodiment, the polarity reversal is achieved by means of a lever switch 78 instead of by means of the two push-buttons 15 and 16; the lever switch 78 has the advantage of being mechanically simpler than the two-push-button system for providing the reversal of the polarity without short-circuiting the power supply.

Figure 7:
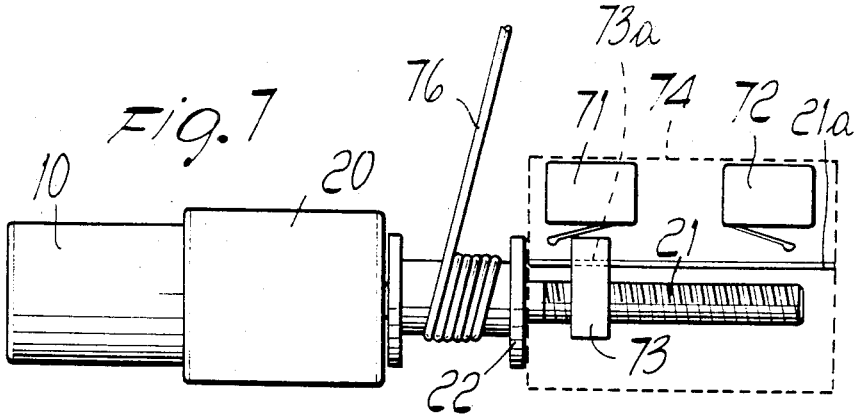
FIG. 7 is a schematic view of the stroke limit safety system assembly applied to the closing and/or securing device.
Figure 10:
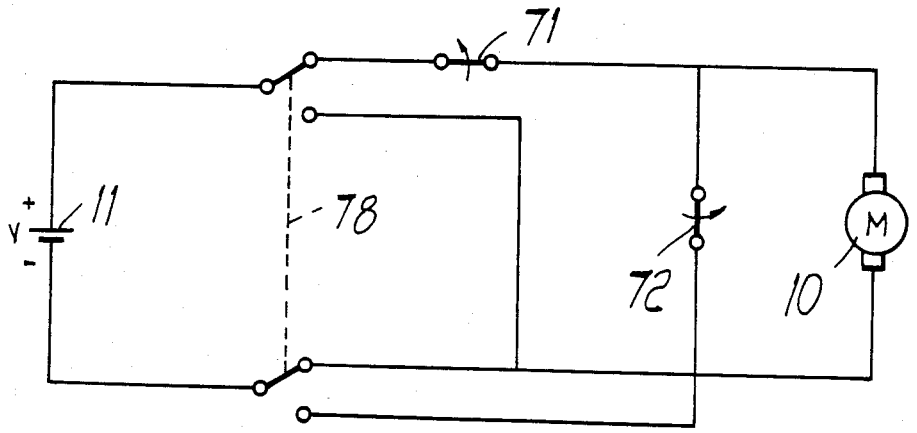
FIG. 10 is an electrical diagram of another operating circuit for the closing and/or securing device, provided with a switching lever.
Figure 12:
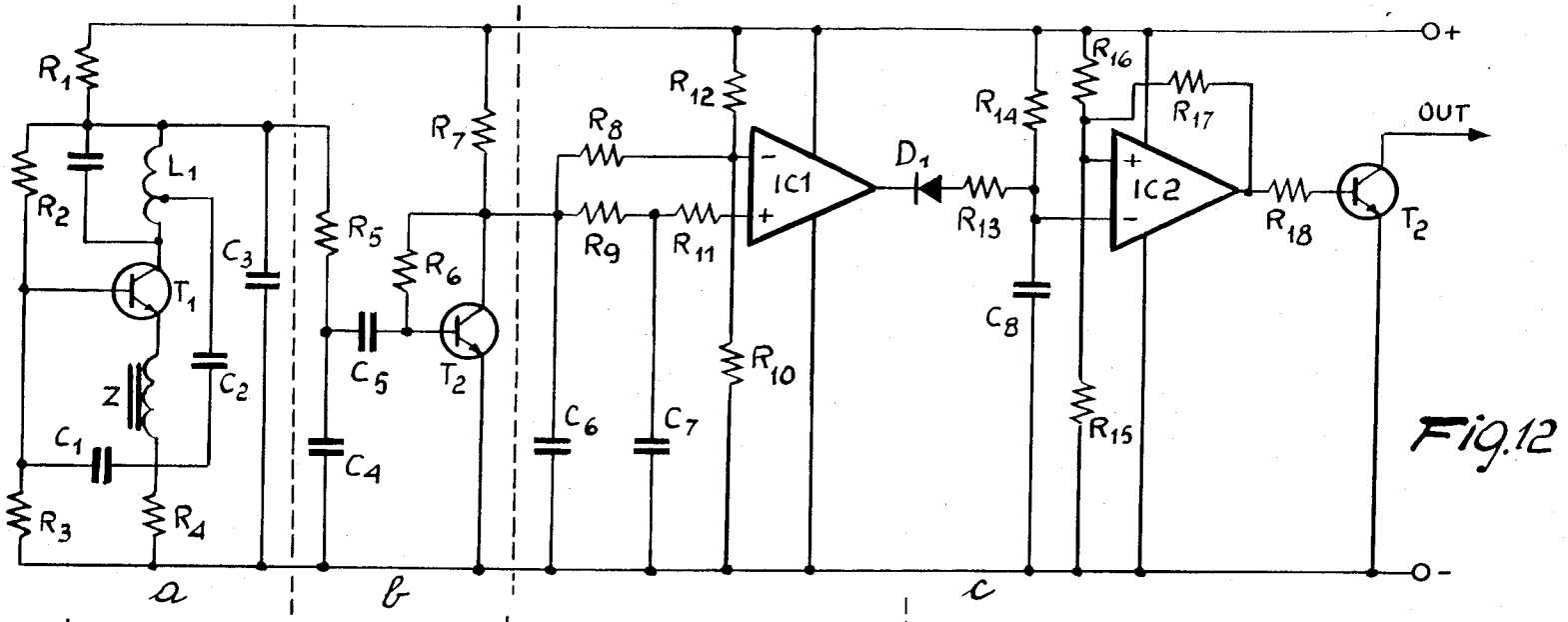
FIG. 12 is a circuit diagram of a receiver cooperating with the transmitter of FIG. 11.
Figure 14:
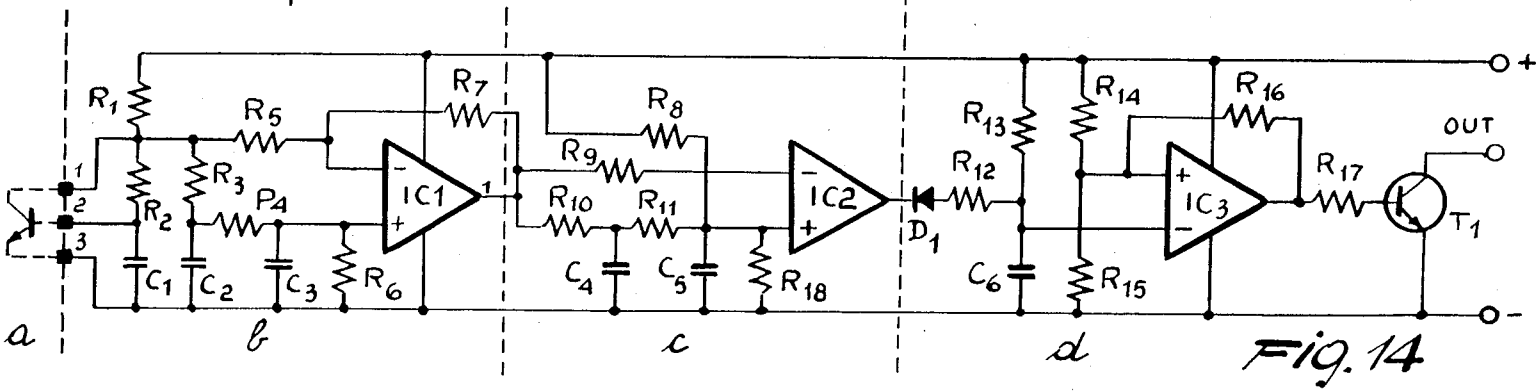
FIG. 14 is a circuit diagram of a receiver cooperating with the infrared ray transmitter.

In order to avoid an overheating of the electric motor and damages to the internal structure of the closing and/or securing device, a stroke limit safety system is provided, which is illustrated schematically in FIG. 7. The safety system comprises two stroke-limiting microswitches 71 and 72 actuated by a pawl 73 which is provided with a threaded hole and engages with the threaded end of the output shaft 21. The pawl 73, suitably shaped, runs inside a guide due to the rotation of the output shaft and interacts with the microswitches 71 and 72, at the two ends of its stroke, breaking the electrical circuit. The guide of the pawl 73 which prevents the rotation thereof around the threaded end of the shaft 21 and allows the motion thereof, can be advantageously in the form of a rod 21*a* parallel to the shaft 21 and fixed to the container of the assembly 74, and slideably traversing a hole 73*a* provided in the pawl 73. FIGS. 9 and 10 show two possible layouts of the operating circuit of the electric motor provided with the stroke limit safety system. Normally, the two microswitches 71 and 72 are closed, i.e. when the pawl 73 is in an intermediate position between the two microswitches; when instead the pawl 73 reaches the end of its stroke, e.g. while winding, it acts on the microswitch 71 which opens, thus cutting off the power supply. The same occurs in the unwinding action where the end of the stroke is determined by the microswitch 72. The microswitches 71 and 72 are preferably mounted on a supporting structure, rigidly coupled with the electric motor-reducer-spool assembly, so as to simplify the assembly and the possible disassembly of the entire complex. It has been noted that in the absence of the stroke-limiting microswitches, when an operating part actuated by the electric motor reaches its stroke limit, the motor keeps on absorbing energy uselessly.

The electric motor 10 is mechanically coupled with a speed reducer 20 the output shaft of which 21 is operatively associated with means for closing the boot and/or for securing the foot inside the boot.

Figure 8:
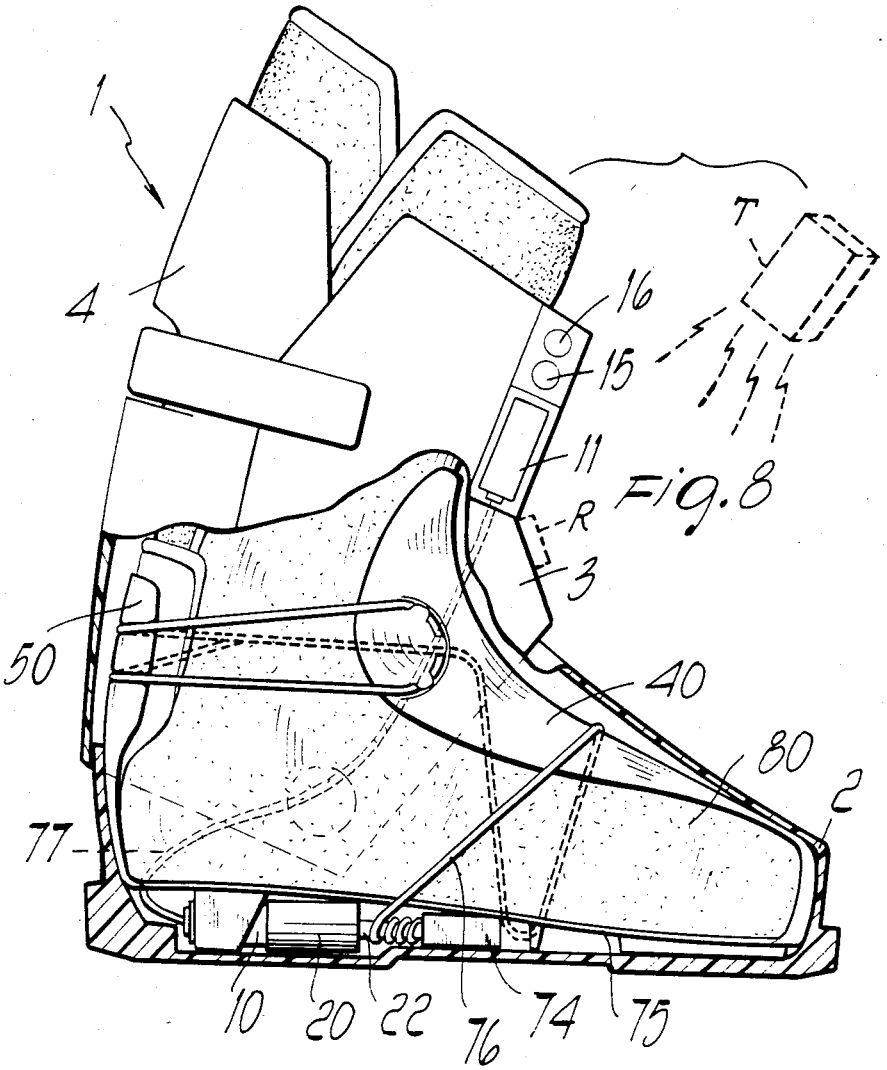
FIG. 8 is a partially cutout lateral elevation view of a ski boot with a foot instep and heel presser locking device.

According to some among possible embodiments of application of the electric motor in the boot, it occurs that the electric motor can be employed to perform the fixing of the foot within the boot. In the embodiment illustrated in FIG. 8 the electric motor 10 and the associated speed reducer 20 are accommodated below the shim 75 within a protective recess provided in part by the heel of the boot and in part by the sole of the boot. The shim 75 is provided with a presser 50 for the heel and with a presser 40 for the foot instep, obtained from a single part by molding. The presser 50 of the heel can also be provided, e.g., directly from the shell, as described in the U.S. patent application Ser. No. 827,031 filed on Feb. 3, 1986 and the U.S. Pat. No. 4,428,130 but any kind of presser can be employed both for the presser 50 of the heel and for the foot instep presser 40. To the output shaft 21 of the electric motor are coupled a spool 22 and the stroke limit safety system assembly, designated with the reference numeral 74, also accommodated below the shim 75. The spool 22 winds a cable 76 which is transmitted, by suitable means, e.g. pulleys or guides, over the foot instep presser 40 and on the heel presser 50 so that, by winding or unwinding the cable 76 on the spool 22, the useful length of the cable 76 is increased or decreased, which cable acts on the pressers 40 and 50 thus varying the pressure on the foot. FIG. 8 shows a possible path of the cable 76, which is guided, e.g, by means of pulleys not illustrated for the sake of clarity. Other kinds of cable paths are illustrated in the U.S. patent application Ser. No. 840,339 filed on Mar. 17, 1986 and the U.S. patent application Ser. No. 737,001 filed on May 23, 1985. The battery 11 and the push-buttons 15 and 16, for actuating the electric motor, are preferably accommodated on the front quarter 3 and are connected to the electric motor 10 by means of an electric cable 77. Obviously, it is possible to accommodate the battery 11 and the push-button 15 and 16 in any other position on the boot which is deemed more suitable. Advantageously the motor-reducer-spool-safety system assembly can be easily removed, by extracting the inner shoe 80 and the shim 75, in case of malfunction of the device, without thereby compromising the functionality of the boot.

In another embodiment, the electric motor can be employed for performing the closing of the quarters.

For this purpose, as illustrated in FIG. 2, the electric motor 10 with the associated speed reducer 20, is accommodated at the rear quarter 4 and at the output shaft 21 arranged upwards. To the output shaft 21 is connected a spool 22 with a diametral slit 23 (FIG. 1) wherein the middle portion of a cable, a band or the like engages, designated with the reference numeral 30, which at its free ends is connected with the sides of the front quarter 3.

With this arrangement, by actuating the electric motor 10 in the direction of winding the cable or band 30 the closing on each other of the quarters is achieved.

In the embodiment illustrated in FIG. 3, to the output shaft 21, which is e.g. directed downwards, is again coupled a spool 22 of a type similar to the one described previously, which actuates a band which is returned, by per se known means, on the foot instep presser 40 which is positioned forwards inside the shell and acts on the inner shoe in a per se known manner.

With reference to FIG. 4, a ski boot is illustrated wherein two motors 10 are provided, and respectively a motor accommodated in the rear quarter and a motor provided in the upper front region of the shell.

The output shaft 21 is in this case operatively interconnected with an internally threaded bush 45, with which a threaded pivot 46 engages, which pivot extends either from a foot instep presser, again designated with the reference numeral 40, or from a heel presser designated with the reference numeral 50.

Since the rotation of the threaded pivot is prevented due to the presence of the passers, upon the rotation of the threaded bush a shifting motion is generated for the related presser, so that the user has the possibility of adjusting the pressure exerted on the foot by the related presser.

Figure 5:
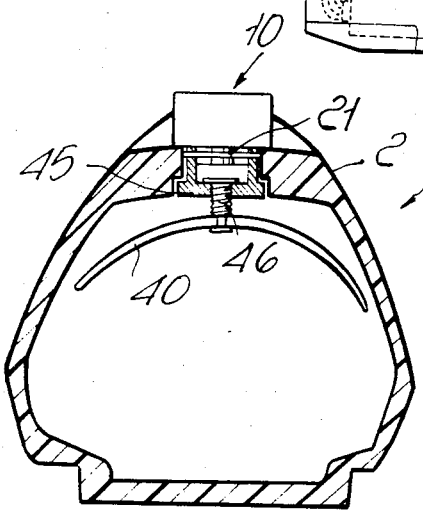
FIG. 5 is a transverse cross section of a ski boot with a foot instep presser device.

In FIG. 5 the structural combination of the bush 21 is schematically better illustrated, which bush is applied in this case to a foot instep presser.

Figure 6:
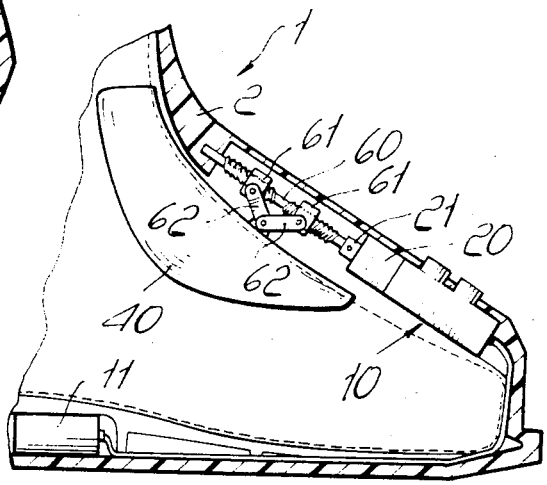
FIG. 6 is a cross section view along a middle plane of a ski boot with a foot instep presser actuating device.

In the embodiment illustrated in FIG. 6, the motor 10, which is accommodated in the internal and front part of the shell. is provided with the output shaft 21 of the speed reducer 20 connected with a pivot with double opposite thread 60 with which engage blocks 61, prevented from rotating and connected to connecting rods 62 which are articulated to the respective block and to the presser so that the rotation in one direction of the double-thread pivot 60 causes the same blocks to move closer to each other, with the consequent closing pushing action on the presser, while a rotation in the opposite direction gives rise to a mutual spacing further apart of the blocks, with the consequent slackening of the pressure exerted on the presser.

To what has been said it must be furthermore added that all the component elements, i.e. the motor, the speed reducer, as well as the electric power source, can be operated in any position of the boot according to the particular actuation to be performed and according to the aesthetics desired for the boot.

It should also be added that it is conceptually possible, instead of the push-buttons directly provided on the electric motor, to perform the actuation of the electric motor by means of a remote radio control which further simplifies the possibility of actuation.

FIG. 8 illustrates by way of example in broken lines the receiver assembly R which receives signals from the remote control T. The receiver and the remote control can be of the radio-wave type or of the infrared-ray type. Circuits of these transceiving devices are illustrated in the FIGS. 11 to 15.

The circuit diagrams illustrated in the FIGS. 11 to 15 are sufficiently eloquent with their symbols for an expert in the field and do not need particular descriptions. It should be noted, on the subject, that the problem of the remote control, for which the solutions have been indicated in the circuit diagrams shown in the drawings, entailed the conditioning of the transmission of the control signals so as to avoid on one hand interferences with neighboring users and on the other to allow an easy directing of the transmitter towards the receiving point of the receiver, the positioning of which must be compatible with the structure and the component parts of the boot.

From what has been described it can thus be observed that the invention achieves the intended aims and in particular the fact is stressed that a ski boot is provided wherein the conventional mechanical actuations, which require an effort on the part of the user, are replaced by an electric motor capable of performing, easily and quickly, and with a small power consumption by virtue of the presence of limit switches, the required motions, also making use of the fact that the employment of a direct-current electric power source allows with ease to vary the direction of rotation of the motor, thus achieving the possibility of performing the opening and the closing of the presser device it is connected to, possibly of the quarters, simply by reversing the power supply of the electric motor.

The invention thus conceived is susceptible of numerous modifications and variations, all of which are within the scope of the inventive concept.

Furthermore, all the details can be replaced by other technically equivalent elements.

In practice, the materials employed, as well as the dimensions and the contingent shapes, may be any according to the requirements.

I claim:

1. A ski boot structure comprising a shell, at least one front quarter, at least one rear quarter, operative component parts and an operating assembly, said at least one front quarter and said at least one rear quarter being associated with said shell, said operative component parts comprising at least one closing device, at least one foot securing device, and an electric power source, said operating assembly being adapted for operating said operative component parts and comprising a reversible electric motor, reversible control means circuit means and transmission means, said reversible electric motor having an output shaft, being adapted for generating rotary motion, and being accommodated in a protective recess, said protective recess being provided in said ski boot structure, said reversible control means being accommodated in said ski boot structure and sensitive to external control action, said circuit means being adapted for electrically connecting said reversible electric motor, said power source and said reversible control means, said transmission means being adapted for transmitting said rotary motion generated by said reversible electric motor to operate said operative component parts, said circuit means and said transmission means comprising mutually cooperating elements, said closing device comprising a spool element and at least one cable, said spool element being keyed to said output shaft of said reversible electric motor and engaging with said at least one cable, said at least one cable being connected to said front quarter, said reversible electric motor being supported by said rear quarter.

2. Ski boot structure according to claim 1 wherein said foot securing device comprises at least one cable element and a foot instep presser, said at least one cable element extending above said foot instep presser, said foot instep presser being positioned inside said shell, said at least one cable engaging with said spool keyed on said output shaft of said reversible electric motor.

3. A ski boot structure according to claim 1, wherein said foot securing device comprises an internally threaded bush, a threaded pivot and a foot instep presser, said internally threaded bush being connected to said output shaft of said reversible electric motor and engaging with said threaded pivot, said threaded pivot being rigidly associated with and extending from said foot instep presser.

4. A ski boot structure according to claim 1 wherein said reversible electric motor is supported by said rear quarter, wherein said shell defines a rear part, and wherein said foot securing device comprises a heel presser, an internally threaded bush and a threaded pivot, said internally threaded bush being connected to said output shaft of said reversible electric motor and engaging with said threaded pivot, said threaded pivot being rigidly associated with and extending from said heel presser, said heel presser being positioned at said rear part defined by said shell.

5. A ski boot structure comprising a shell, at least one front quarter, at least one rear quarter, operative component parts and an operating assembly, said at least one front quarter and said at least one rear quarter being associated with said shell, said operative component parts comprising at least one closing device, at least one foot securing device, and an electric power source, said operating assembly being adapted for operating said operative component parts and comprising a reversible electric motor, reversible control means circuit means and transmission means, said reversible electric motor having an output shaft, being adapted for generating rotary motion, and being accommodated in a protective recess, said protective recess being provided in said ski boot structure, said reversible control means being accommodated in said ski boot structure and sensitive to external control action, said circuit means being adapted for electrically connecting said reversible electric motor, said power source and said reversible control means, said transmission means being adapted for transmitting said rotary motion generated by said reversible electric motor to operate said operative component parts, said circuit means and said transmission means comprising mutually cooperating elements, said ski boot structure defining a front upper part, said reversible electric motor being supported on said front upper part of said ski boot structure, said foot securing device comprising an internally threaded bush, a threaded pivot and a foot instep presser, said internally threaded bush being connected to said output shaft of said reversible electric motor and engaging with said threaded pivot, said threaded pivot being rigidly associated with and extending from said foot instep presser, said foot instep presser being located inside said ski boot structure.

6. A ski boot structure comprising a shell, at least one front quarter, at least one rear quarter, operative component parts and an operating assembly, said at least one front quarter and said at least one rear quarter being associated with said shell, said operative component parts comprising at least one closing device, at least one foot securing device, and an electric power source, said operating assembly being adapted for operating said operative component parts and comprising a reversible electric motor, reversible control means circuit means and transmission means, said reversible electric motor having an output shaft, being adapted for generating rotary motion, and being accommodated in a protective recess, said protective recess being provided in said ski boot structure, said reversible control means being accommodated in said ski boot structure and sensitive to external control action, said circuit means being adapted for electrically connecting said reversible electric motor, said power source and said reversible control means, said transmission means being adapted for transmitting said rotary motion generated by said reversible electric motor to operate said operative component parts, said circuit means and said transmission means comprising mutually cooperating elements, said reversible control means comprising polarity reversing switches and being adapted for receiving remote control signals.

7. Ski boot structure according to claim 6 wherein said closing device comprises a spool element and at least one cable, said spool element being keyed to said output shaft of said reversible electric motor and engaging with said at least one cable, said at least one cable being connected to said front quarter, said reversible electric motor being supported by said rear quarter.

8. Ski boot structure according to claim 6 wherein said foot securing device comprises at least one cable element and a foot instep presser, said at least one cable element extending above said foot instep presser, said foot instep presser being positioned inside said shell, said at least one cable engaging with said spool keyed on said output shaft of said reversible electric motor.

9. A ski boot structure according to claim 6, wherein said foot securing device comprises an internally threaded bush, a threaded pivot and a foot instep presser, said internally threaded bush being connected to said output shaft of said reversible electric motor and engaging with said threaded pivot, said threaded pivot being rigidly associated with and extending from said foot instep presser.

10. A ski boot structure according to claim 6, wherein said reversible electric motor is supported by said rear quarter, wherein said shell defines a rear part, and wherein said foot securing device comprises a heel presser, an internally threaded bush and a threaded pivot, said internally threaded bush being connected to said output shaft of said reversible electric motor and engaging with said threaded pivot, said threaded pivot being rigidly associated with and extending from said heel presser, said heel presser being positioned at said rear part defined by said shell.

11. A ski boot structure according to claim 6, wherein said reversible control means further comprise push button controls, and at least one interlock mechanism, said push button controls being externally accessible and mounted on said ski boot structure, said interlock mechanism being adapted to prevent simultaneous closure of said polarity reversing switches.

12. Ski boot structure according to claim 6 wherein said closing device comprises a spool element and at least one cable, said spool element being keyed to said output shaft of said reversible electric motor and engaging with said at least one cable, said at least one cable being connected to said front quarter, said reversible electric motor being supported by said rear quarter, said reversible control means further comprising push button controls, and at least one interlock mechanism, said push button controls being externally accessible and mounted on said ski boot structure, said interlock mechanism being adapted to prevent simultaneous closure of said polarity reversing switches.

13. Ski boot structure according to claim 6 wherein said foot securing device comprises at least one cable element and a foot instep presser, said at least one cable element extending above said foot instep presser, said foot instep presser being positioned inside said shell, said at least one cable engaging with said spool keyed on said output shaft of said reversible electric motor, and wherein said reversible control means further comprise push button controls, and at least one interlock mechanism, said push button controls being externally accessible and mounted on said ski boot structure, said interlock mechanism being adapted to prevent simultaneous closure of said polarity reversing switches.

14. A ski boot structure according to claim 6, wherein said foot securing device comprises an internally threaded bush, a threaded pivot and a foot instep presser, said internally threaded bush being connected to said output shaft of said reversible electric motor and engaging with said threaded pivot, said threaded pivot being rigidly associated with and extending from said foot instep presser and wherein said reversible control means further comprise push button controls, and at least one interlock mechanism, said push button controls being externally accessible and mounted on said ski boot structure, said interlock mechanism being adapted to prevent simultaneous closure of said polarity reversing switches.

15. A ski boot structure according to claim 6, wherein said reversible electric motor is supported by said rear quarter, wherein said shell defines a rear part, and wherein said foot securing device comprises a heel presser, an internally threaded bush and a threaded pivot, said internally threaded bush being connected to said output shaft of said reversible electric motor and engaging with said threaded pivot, said threaded pivot being rigidly associated with and extending from said heel presser, said heel presser being positioned at said rear part defined by said shell, said reversible control means further comprise push button controls, and at least one interlock mechanism, said push button controls being externally accessible and mounted on said ski boot structure, said interlock mechanism being adapted to prevent simultaneous closure of said polarity reversing switches.

* * * * *